US005826783A

United States Patent [19]

Stout

[11] Patent Number: 5,826,783

[45] Date of Patent: Oct. 27, 1998

[54] TWO-TIER CAN PACKAGE HAVING DIVIDER PANEL AND METHOD OF FORMING THE SAME

[75] Inventor: James T. Stout, Ellijay, Ga.

[73] Assignee: The Mead Corporation, Dayton, Ohio

[21] Appl. No.: 871,651

[22] Filed: Jun. 9, 1997

[51] Int. Cl.[6] ..... B65D 5/49

[52] U.S. Cl. ..... 229/120.32; 206/427; 229/900; 493/92; 493/181; 493/912

[58] Field of Search ..... 206/140, 141, 206/427, 434; 229/120.32, 120.37, 120.38, 900; 493/90, 92, 180, 181, 182, 309, 311, 912

[56] References Cited

U.S. PATENT DOCUMENTS

| | | | |
|---|---|---|---|
| 1,935,923 | 11/1933 | Thoke | 229/120.32 |
| 2,218,360 | 10/1940 | Rokol | 229/120.32 |
| 3,009,625 | 11/1961 | Ackley et al. | 229/120.38 |
| 3,351,264 | 11/1967 | Bostrom | 229/120.32 |
| 4,421,229 | 12/1983 | Pan et al. | 229/120.32 |
| 5,098,015 | 3/1992 | Calvert | 229/900 |
| 5,307,932 | 5/1994 | Stout et al. | 206/141 |
| 5,320,277 | 6/1994 | Stout et al. | 229/117.13 |
| 5,437,143 | 8/1995 | Culpepper et al. . | |
| 5,482,203 | 1/1996 | Stout | 229/117.13 |
| 5,518,111 | 5/1996 | Stout | 206/160 |
| 5,682,984 | 11/1997 | Hoell et al. | 206/427 |
| 5,772,030 | 6/1998 | Baxter | 206/427 |

FOREIGN PATENT DOCUMENTS

| | | |
|---|---|---|
| WO 94/20369 | 9/1994 | WIPO . |
| WO 96/38348 | 12/1996 | WIPO . |

*Primary Examiner*—Gary E. Elkins
*Attorney, Agent, or Firm*—Thomas A. Boshinski

[57] ABSTRACT

A collapsed carton for subsequent setup to receive articles includes top and bottom panels and a pair of side panels. End closure flaps extend from opposite side edges of each of the side panels to close the tubular carton when set up. A divider panel is disposed within the tubular structure between the top and bottom panels. A pair of glue flaps are foldably connected to the divider panel side edges, each of the glue flaps being secured to an inner surface of one of the side panels to retain the divider panel within the tubular structure. At least one divider end flap is foldably connected to one of the divider panel end edges. A first aperture is defined through one divider end flap. A second aperture is defined through one of the end closure flaps at one of the tubular ends of the carton to coincide with the first aperture when the carton is collapsed.

6 Claims, 6 Drawing Sheets

TWO-TIER CAN PACKAGE HAVING DIVIDER PANEL AND METHOD OF FORMING THE SAME

BACKGROUND OF THE INVENTION

This invention relates generally to packages of articles such as beverage cans arranged in two or more tiers, and more particularly to such packages having divider panels between tiers of articles. The invention also relates to a method of forming such packages.

One way to package articles such as beverage cans is to place the cans into a paperboard carton in which the cans are arranged in two tiers. An example of this can be seen in U.S. Pat. No. 5,437,143 wherein two tiers of six cans are shown being placed into a carton to form a twelve-pack.

In cartons of this type, to avoid unwanted can-to-can contact between the tiers, it is common for a paperboard divider panel to be used to separate the tiers. The common practice, as shown generally in the above referenced U.S. Pat. No. 5,437,143, is to first form the cans which will occupy the lower tier into a shaped group outside of the carton. After this group is formed, the paperboard divider is placed onto the top of the cans of the lower group. Cans which will occupy the upper tier are then directed onto the panel and arranged into the upper group. The completed assembly is then loaded into the carton through an open end.

This procedure requires specialized machinery to carry out this operation. One example of machinery of this type can be seen by reference to PCT Published Application No. WO94/20369. Because this machinery is relatively complex, requiring the formation of the can groups at two separate locations outside the carton, the machinery is relatively expensive to manufacture. Moreover, because such machinery differs from that which has been traditionally used to load beverage cartons, new machines must be acquired in order to load cartons of this type.

To avoid this problem, it is known to form the cartons with the paperboard divider already positioned within the carton before the carton is loaded. PCT Published Application No. WO96/38348 shows such a carton in which the divider is manufactured as a part of the carton, with both portions formed as a single blank. This carton enables a significantly less complex machine to be used for loading, and it is also possible to modify conventional machines for this purpose. However, the required carton is relatively expensive because a very large blank is required. It is far more economical to manufacture the carton and divider as separate blanks, and glue the divider into the carton. But this in turn introduces a problem in accurately positioning the divider within the carton. If the divider is not properly positioned, the loading of cans into both tiers is not possible.

Accordingly, what is needed is a carton and manufacturing method which enables a separate carton blank and divider to be formed, but which permits the divider to be accurately positioned and glued into the carton without adversely affecting normal carton manufacturing and gluing operations and speeds. Moreover, the carton should be relatively economical in terms of paperboard usage and manufacturing costs when compared with similar cartons formed from a single blank.

SUMMARY OF THE INVENTION

In meeting the foregoing needs, the present invention provides a collapsed carton for subsequent setup to receive articles to be packaged therein, the carton including top and bottom panels and a pair of side panels, the panels being interconnected to form a collapsed tubular structure having a pair of ends. End closure flaps are connected at and extend from opposite side edges of each of the side panels, and are disposed so as to extend across the tubular axis at each of the tubular ends when the carton is set up.

A divider panel is disposed within the interior of the tubular structure between and substantially parallel to the top and bottom panels, the divider panel having opposed divider panel side edges and opposed divider panel end edges. A pair of glue flaps is provided, each foldably connected to one of the divider panel side edges, each of the glue flaps being secured to an inner surface of one of the side panels to retain the divider panel within the tubular structure. At least one divider end flap is foldably connected to one of the divider panel end edges, the divider end flap being disposed to extend from the divider panel substantially adjacent the end closure flaps.

A first aperture is defined through one divider end flap. A second aperture is defined through one of the end closure flaps at one of the tubular ends of the carton to coincide with the first aperture when the carton is collapsed.

The carton may further include a second divider end flap foldably connected to the other of the divider panel end edges, the second divider end flap being disposed to extend downwardly from the divider panel adjacent the end closure flaps. A third aperture is defined through the second divider end flap. A fourth aperture is defined through one of the end closure flaps at the other of the tubular ends to coincide with the third aperture when the carton is collapsed.

The present invention also provides a method of forming a collapsed carton having a divider panel secured therein. The method includes the steps of providing a carton blank having interconnected main panels including top, bottom and a pair of side panels, a blank glue flap connected at an end edge of one of the main panels at one end of the blank, and end closure flaps connected at opposite side edges of each of the side panels. A divider panel is provided having dimensions substantially similar to the top and bottom panels, the divider panel having opposed divider panel side edges and opposed divider panel end edges, a pair of divider glue flaps, each foldably connected to one of the divider panel side edges, and at least one divider panel end flap foldably connected to one of the divider panel end edges.

A first aperture is formed through one divider end flap, and a second aperture is formed through one of the end closure flaps at one of the tubular ends of the carton. A pin is positioned through the first and second apertures to retain the divider and the blank in relative position, and one of the divider glue flaps is secured to an inner surface of one of the side panels. The blank is then folded to form a collapsed tubular structure, and blank glue flap is secured to an opposite end of the blank. The other of the divider glue flaps is secured to the other of the side panels.

The method may include the further steps of forming as part of the divider a second divider end flap at an opposite end edge of the divider panel, forming a third aperture through the second divider end flap, and forming a fourth aperture through one of the end closure flaps at an opposite one of the tubular ends. A pin is positioned through the third and fourth apertures to further retain the divider and the blank in relative position.

The securing of the blank glue flap to the opposite end of the blank and the securing of the other of the divider glue flaps to the other of the side panels may be performed substantially simultaneously.

The method may include the further step of withdrawing the pin from the first and second apertures.

DETAILED DESCRIPTION OF THE PREFERRED EMBODIMENT

The present invention is intended primarily for use with aluminum or steel cans of the type used in packaging beverages. The cans are packaged into a carton in two layers or tiers.

Figure 1:
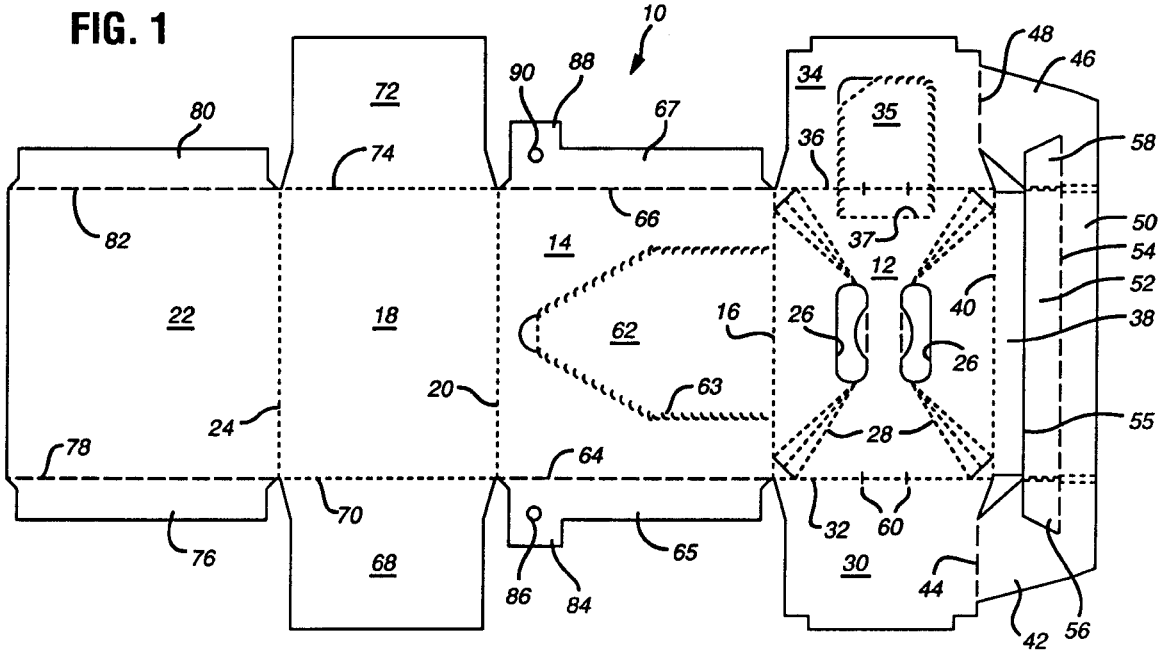
FIG. 1 is a plan view of the inner surface of a blank for forming a carton in accordance with the present invention.

A blank for forming a carton in accordance with the present invention may be seen by reference to FIG. 1. The blank 10 includes a top wall panel 12 connected to a side wall panel 14 along fold line 16. A bottom wall panel 18 is connected to side wall panel 14 along fold line 20, and at its opposite side is connected to side wall panel 22 along fold line 24.

Top wall panel 12 includes a pair of hand apertures 26 for forming a portion of a handle structure for the carton. Additionally, reinforcing fold lines 28 extend from apertures 26 toward the corners of top wall panel 12, in accordance with the handle structure disclosed in U.S. Pat. No. 5,307,932. However, other known arrangements of reinforcing fold lines may be used. In some cases, the fold lines may even be eliminated.

A major end flap 30 is connected at one end edge of top wall panel 12 along fold line 32, while a second major end flap 34 is connected at the opposite end of top wall panel 12 along fold line 36. A glue flap 38 is connected to top wall panel 12 along fold line 40.

Major end flap 34 includes a tearable access panel 35 formed therein by a series of perforations in a manner which is known in the art. Access panel 35 extends across fold line 36 and into top panel 12, where it is connected to top panel 12 along a fold line 37.

A handle reinforcing structure in accordance with the present invention is connected to each of major end flaps 30 and 34, and comprises end portion 42 connected to major end flap 30 along fold line 44, and end portion 46 connected to major end flap 34 along fold line 48. A central portion 50 interconnects end portions 42 and 46. An auxiliary handle reinforcing strip 52 is connected to central portion 50 along a fold line 54. Reinforcing strip 52 is positioned adjacent to glue flap 38, separated therefrom along a cut line 55.

Auxiliary reinforcing strip 52 includes end flap 56 which extends into end portion 42, and end flap 58 which extends into end portion 46.

End flaps 56 and 58 are connected to the central portion of reinforcing strip 52 along fold lines which are debossed so as to protrude inwardly of the erected carton. Similarly, end reinforcing portions 42 and 46 are connected to central portion 50 along fold lines debossed inwardly. These debossed areas mate with an area along respective ones of fold lines 32 and 36 which are encased by torque relief slits 60 to thereby reduce tension along the outer surfaces of the fold lines between top wall panel 12 and major end flaps 30 and 34. Further details regarding this structure may be found by reference to U.S. Pat. No. 5,320,277, which is incorporated herein by reference.

Side wall panel 14 includes a removable access panel 62 defined by a perforated tear line 63. Connected at one end edge of side wall panel 14 along fold line 64 is a minor end flap 65, and connected by a fold line 66 at an opposite end edge is minor end flap 67.

Bottom wall panel 18 has a major end flap 68 connected along fold line 70 at one end edge thereof, while a second major end flap 72 is connected at an opposite end edge along fold line 74.

Finally, side wall panel 22 includes a minor end flap 76 connected at one end edge along fold line 78, and a minor end flap 80 connected along fold line 82 at the opposite end edge.

Continuing to refer to FIG. 1, minor end flap 65 can be seen to have an extension portion 84 located at the lower portion of flap 65 near bottom wall panel 18. Formed through extension portion 84 is a circular aperture 86 which, as will be explained below, is used in accordance with the present invention to position the divider panel during formation of the carton.

Minor end flap 67 similarly includes an extension portion 88 located along its lower portion. A similar aperture 90 is formed through extension portion 88.

Figure 2:
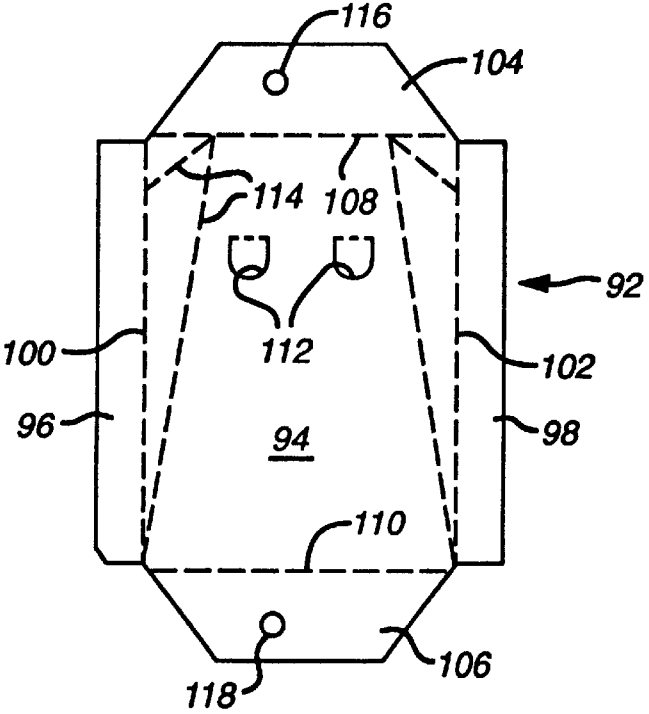
FIG. 2 is a plan view of the divider also used in forming a carton in accordance with the present invention.

A preferred form for the divider used in the package of the present invention may be seen by reference to FIG. 2. Divider 92 includes a main panel 94 having a pair of glue flaps 96 and 98 connected along each side edge of panel 94 by fold lines 100 and 102 respectively. At the end edges of panel 94 are a pair of end flaps 104 and 106, connected along fold lines 108 and 110 respectively.

Main panel 94 includes formed therein a pair of finger apertures 112. As is explained in detail in U.S. Pat. No. 5,518,111, which is hereby incorporated by reference, the completed package may be opened by tearing away access panel 35 (see FIG. 1). To access the lower layer of cans, however, the divider must be removed from the package. Finger apertures 112 permit the user of the package to grip the divider to facilitate removal by pulling the divider through access opening 35.

Similarly, main panel 94 includes a plurality of diverging fold lines 114. As also explained in the above referenced U.S. Pat. No. 5,518,111, fold lines 114 assist the divider in "collapsing" to the degree necessary to permit its removal through access opening 35.

End flap 104 is provided with a circular aperture 116 formed through the flap. End flap 106 is provided with a similar circular aperture 118. These apertures cooperate with apertures 86 and 90 formed in blank 10 in a manner to be described below.

Figure 3:
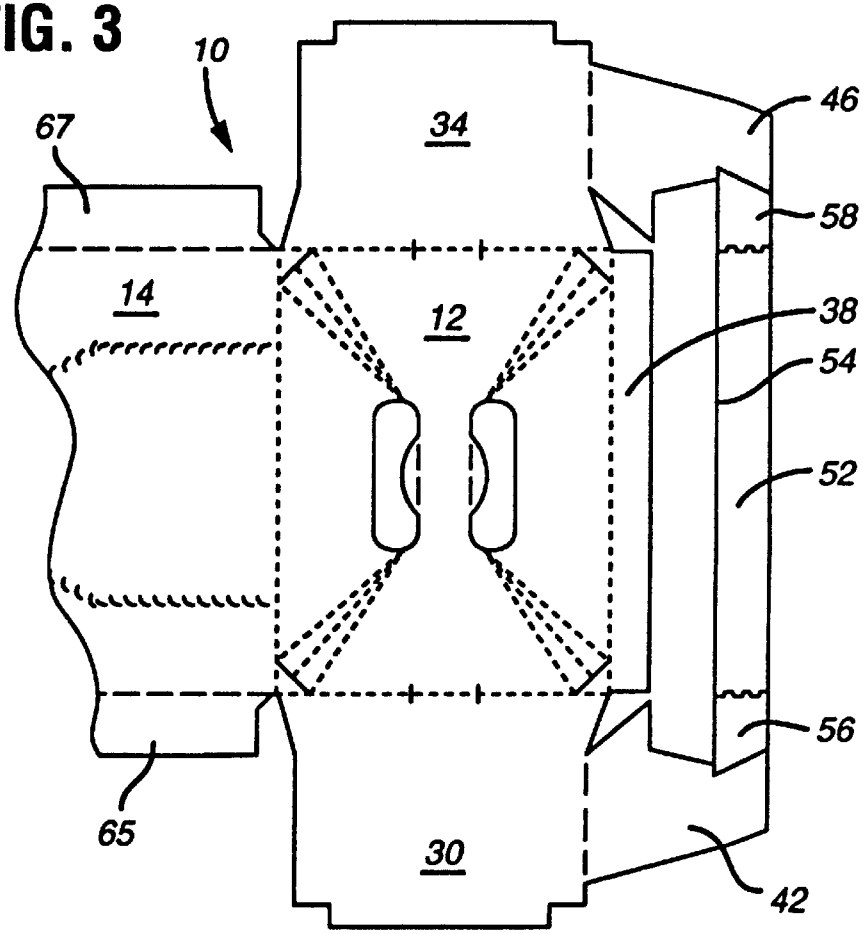
FIG. 3 is a partial plan view similar to FIG. 1, showing a first step in the formation of a carton from the blank of FIG. 1.

Referring now to FIG. 3, the beginning of the assembly process for forming the package from blank 10 and divider 92 can be seen. The assembly may preferably be carried out on commercially-available, conventional high-speed folding and gluing equipment. Auxiliary reinforcing strip 52 is folded about fold line 54 and glued to the central portion 50 of the handle reinforcing structure, while flaps 56 and 58 are glued to end portions 42 and 46 respectively.

Figure 4:
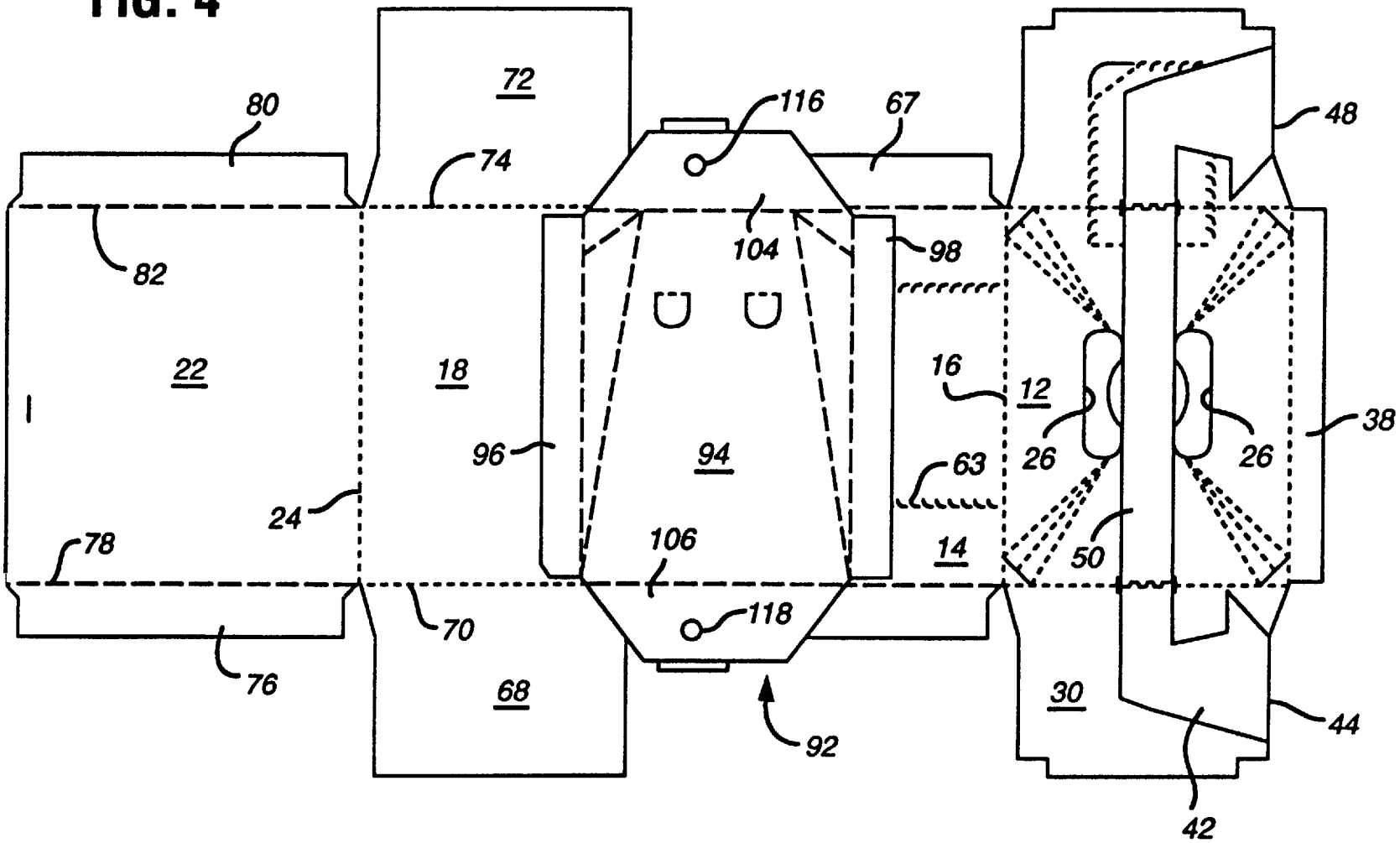
FIGS. 4 is a plan view of the blank of FIG. 1 with the divider of FIG. 2 positioned thereon, further illustrating the formation of the carton.

Next, as shown in FIG. 4, the handle reinforcing structure is folded about fold lines 44 and 48, and end portions 42 and 46 are glued to major end panels 30 and 34, respectively. Central portion 50, and the auxiliary reinforcing flap 52 adhered thereto, are glued to top wall panel 12, so as to extend along the region between the hand apertures 26. Thus, a triple-ply reinforced structure between the apertures 26 is formed. Further details regarding this structure can be seen by reference to U.S. Pat. No. 5,482,203, which is incorporated herein by reference.

As the carton is folded and glued, it is advanced through the folding and gluing equipment by various belts, pushers, guides and the like. Near the beginning of the process, a pin is introduced into each of apertures 86 and 90 (which can be seen in FIG. 1). These pins are advanced along with the blank 10 as it is moved through the folding and gluing equipment.

Continuing to refer to FIG. 4, glue is applied to the underside of glue flap 98 formed along one side edge of divider 92. Divider 92 is then positioned on blank 10, with the glued surface of flap 98 in contact with side wall panel 14. The same pins which extend through apertures 86 and 90 in blank 10 are introduced into apertures 118 and 116, respectively, formed into the end flaps 106 and 104 of the divider 92. Thus, the pins register the apertures, and thereby accurately position divider 92 on blank 10.

After the glue applied to flap 98 has set sufficiently to hold divider 92 in position, the pins may be removed from apertures 86 and 90 and 118 and 116.

Figure 5:
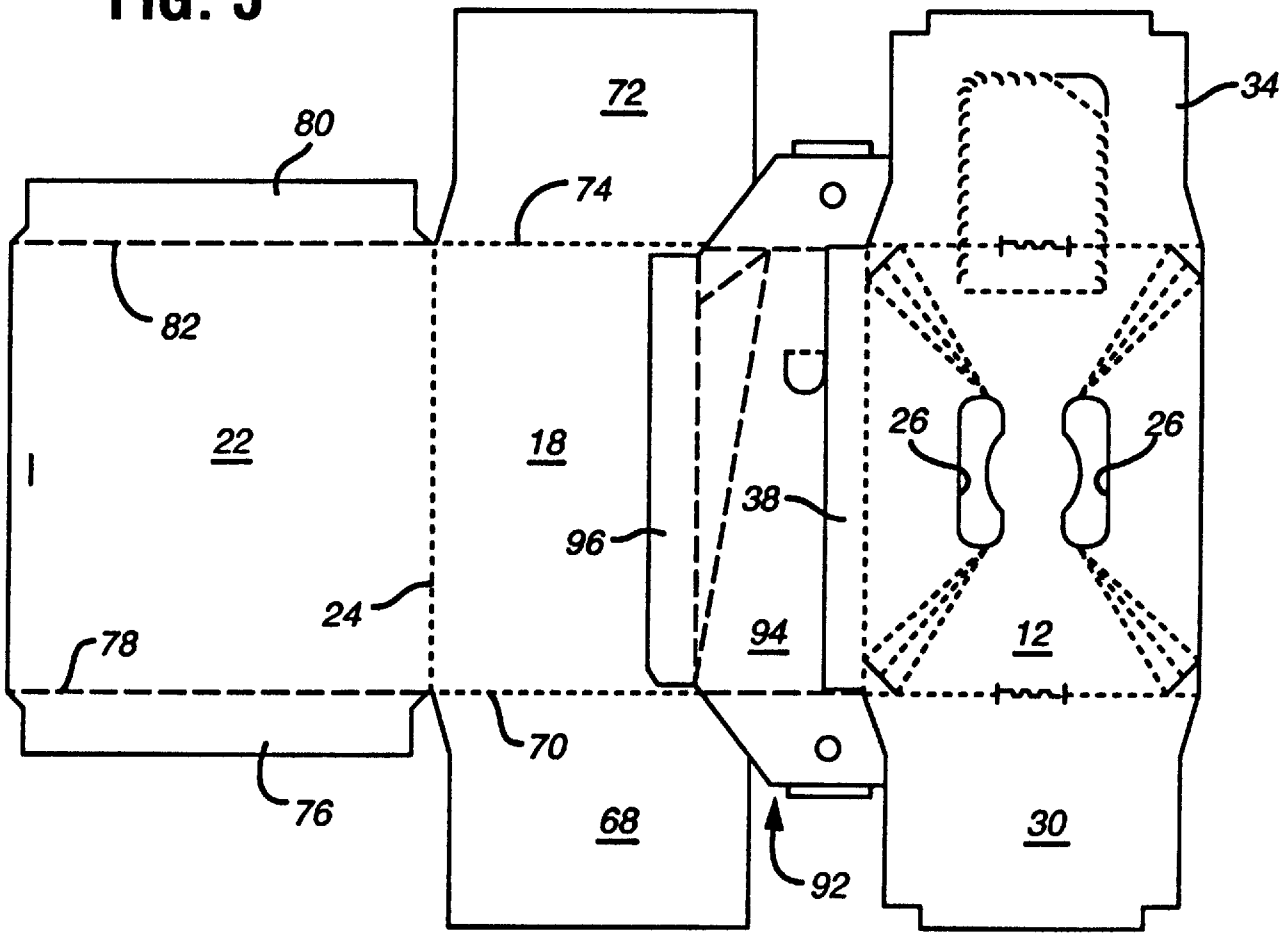
FIGS. 5 and 6 are views similar to FIG. 4 illustrating further steps in the formation of the carton.
Figure 6:
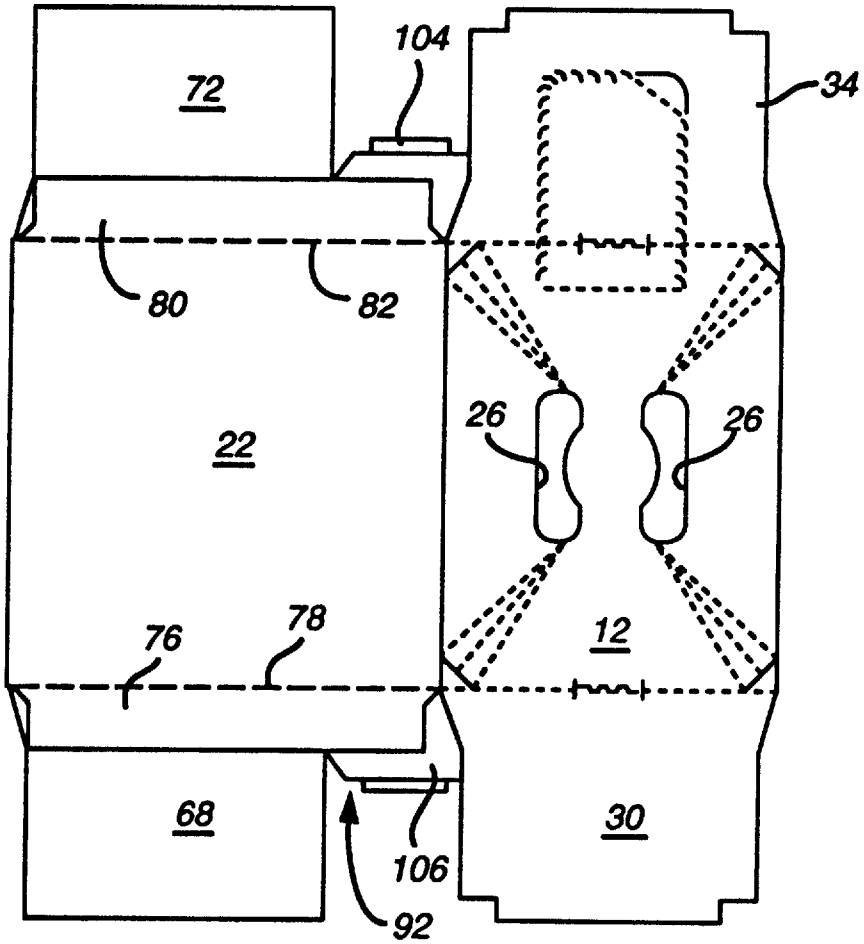

The remainder of the assembly of carton 10 can be seen by reference to FIGS. 5 and 6. In FIG. 5, the top wall panel 12 is shown folded along fold line 16 into overlapping arrangement with side wall panel 14 and a portion of divider 92.

Glue is the applied along glue flap 38 and glue flap 96. As shown in FIG. 6, side wall panel 22 is folded along fold line 24. The upper edge of side wall panel 22 is then adhered to glue flaps 38 and 96 to complete the collapsed carton. It will be recognized that the carton is now in the form of a collapsed sleeve, in which the divider 92 is glued between the side wall panels 14 and 22.

Figure 7:
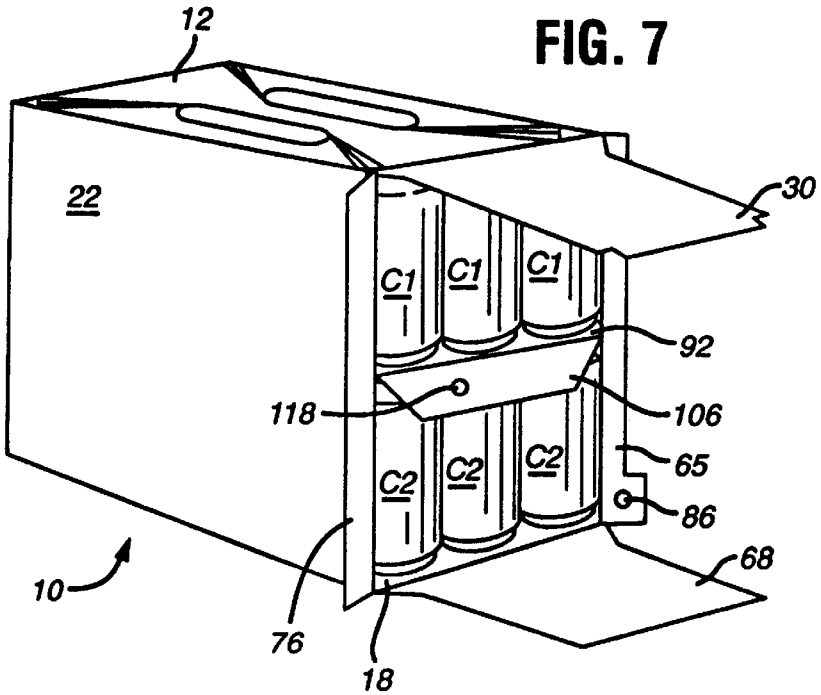
FIG. 7 is a three-quarter view of the top, side and end of an erected and loaded carton formed from the blank of FIG. 1, showing the end closure structure prior to folding and sealing.

To load the carton, it is first erected into a tubular structure. The cans are then placed into the carton. The loaded carton is shown in FIG. 7, with its end closure structure, comprising major end flaps 30 and 68 and minor end flaps 65 and 76, open prior to the application of glue for sealing. The carton is loaded, as shown here for example, with beverage cans arranged into two tiers. The divider 92 can be seen disposed between the tiers. Cans C1 of the upper tier are positioned on divider 92, which in turn rests upon the tops of the cans C2 of the lower tier. Cans C2 are in turn positioned on the bottom wall panel 18 of the carton 10.

The actual loading of the cans into the carton may be carried out by suitable, automated packaging machinery. It may be performed in several ways, although it is preferred to load the cans C2 of the lower tier first, so that they may be support the weight of the cans C1 of the upper tier as they are loaded. Both tiers may be loaded from one end of the carton, in which case the end closure flaps at the opposite end of the carton may be closed and sealed prior to loading. Alternatively, the lower tier may be loaded from one end of the carton, while the upper tier is loaded from the opposite end. As a further alternative, one or both tiers may be partially loaded from both ends.

Closure and sealing of the end closure structure is effected in the following manner. Minor end flaps 65 and 76 are folded to a closed position against the packaged cans. Glue is applied to minor end flaps 65 and 76 and, preferably, to end flap 106 attached along a fold line to the edge of divider 92. Major end flap 30 is then folded downwardly and secured to the flaps 65, 76 and 106. Additional glue is applied to the outer end of the inner surface of major end flap 68, which is folded upwardly and sealed to major end flap 30.

An identical operation is carried out to close and seal end closure structure located at the opposite end of the carton. It will be recognized that the apertures 86, 90, 116 and 118 used to properly position the divider during carton assembly do not interfere with the flap sealing operation.

Figure 8:
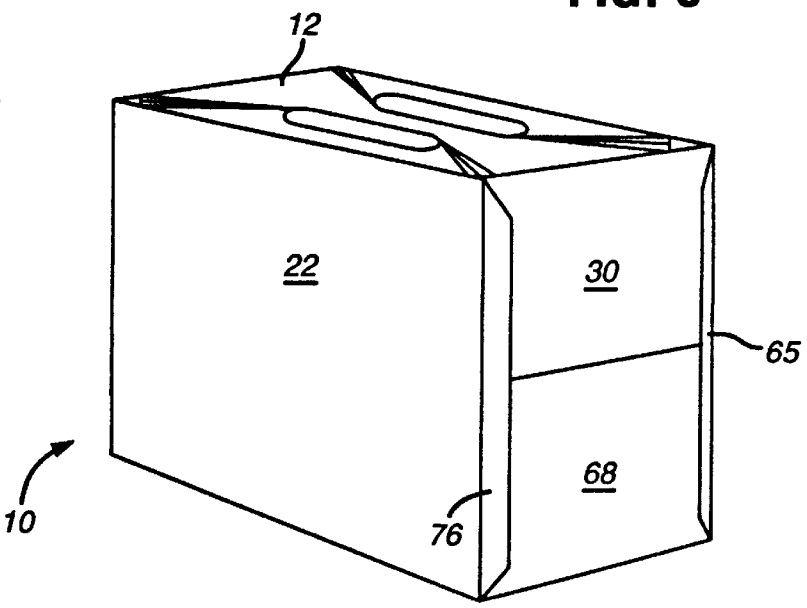
FIG. 8 is a view similar to FIG. 7, but showing the end closure structure sealed to form the finished carton.

The loaded and sealed carton may be seen by reference to FIG. 8.

It will be recognized that as used herein, directional references such as "top", "bottom", "end" and "side" do not limit the respective panels to such orientation, but merely serve to distinguish these panels one from another.

What is claimed is:

1. A collapsed carton for subsequent setup to receive articles to be packaged therein, comprising:

top and bottom panels and a pair of side panels, said panels being interconnected to form a collapsed tubular structure having a pair of ends;

end closure flaps connected at and extending from opposite side edges of each of said side panels disposed so as to extend across said tubular axis at each of said tubular ends when said carton is set up;

a divider panel disposed within the interior of said tubular structure between and substantially parallel to said top and bottom panels, said divider panel having opposed divider panel side edges and opposed divider panel end edges;

a pair of glue flaps, each foldably connected to one of said divider panel side edges, each of said glue flaps being secured to an inner surface of one of said side panels to retain said divider panel within said tubular structure;

at least one divider end flap foldably connected to one of said divider panel end edges, said divider end flap being disposed to extend from said divider panel substantially adjacent said end closure flaps;

a first aperture defined through said one divider end flap; and a second aperture defined through one of said end closure flaps at one of said tubular ends to coincide with said first aperture when said carton is collapsed.

2. A carton as defined in claim 1, further comprising:

a second divider end flap foldably connected to the other of said divider panel end edges, said second divider end flap being disposed to extend downwardly from said divider panel adjacent said end closure flaps;

a third aperture defined through said second divider end flap; and a fourth aperture defined through one of said end closure flaps at the other of said tubular ends to coincide with said third aperture when said carton is collapsed.

3. A method of forming a collapsed carton having a divider panel secured therein, comprising the steps of:

providing a carton blank having interconnected main panels including top, bottom and a pair of side panels, a blank glue flap connected at an end edge of one of said main panels at one end of the blank, and end closure flaps connected at opposite side edges of each of said side panels; and providing a divider panel having dimensions substantially similar to said top and bottom panels, said divider panel having opposed divider panel side edges and opposed divider panel end edges, a pair of divider glue flaps, each foldably connected to one of said divider panel side edges, and at least one divider panel end flap foldably connected to one of said divider panel end edges;

forming a first aperture through said one divider end flap;

forming a second aperture through one of said end closure flaps at one of said tubular ends;

positioning a pin through said first and second apertures to retain said divider and said blank in relative position;

securing one of said divider glue flaps to an inner surface of one of said side panels;

folding said blank to form a collapsed tubular structure and securing said blank glue flap to an opposite end of said blank; and securing the other of said divider glue flaps to the other of said side panels.

4. The method of claim 3, further comprising:

forming as part of said divider a second divider end flap at an opposite end edge of said divider panel;

forming a third aperture through said second divider end flap;

forming a fourth aperture through one of said end closure flaps at an opposite one of said tubular ends; and positioning a pin through said third and fourth apertures to further retain said divider and said blank in relative position.

5. The method of claim 3, wherein said securing of said blank glue flap to said opposite end of said blank and said securing of the other of said divider glue flaps to the other of said side panels are performed substantially simultaneously.

6. The method of claim 3, comprising the further step of withdrawing said pin from said first and second apertures.

* * * * *